US010189662B2

(12) United States Patent
Okano

(10) Patent No.: US 10,189,662 B2
(45) Date of Patent: Jan. 29, 2019

(54) MEDIUM SUPPLYING APPARATUS

(71) Applicant: PFU LIMITED, Ishikawa (JP)

(72) Inventor: Shigeharu Okano, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 15/482,097

(22) Filed: Apr. 7, 2017

(65) Prior Publication Data

US 2017/0210582 A1 Jul. 27, 2017

Related U.S. Application Data

(63) Continuation of application No. PCT/JP2014/077249, filed on Oct. 10, 2014.

(51) Int. Cl.
*B65H 7/12* (2006.01)
*B65H 3/06* (2006.01)
(Continued)

(52) U.S. Cl.
CPC ..... *B65H 7/125* (2013.01); *B65H 3/06* (2013.01); *B65H 3/5261* (2013.01); *B65H 5/062* (2013.01);
(Continued)

(58) Field of Classification Search
CPC . B65H 7/125; B65H 7/12; B65H 3/06; B65H 5/062; B65H 2301/4234; B65H 2511/524
See application file for complete search history.

(56) References Cited

U.S. PATENT DOCUMENTS 5,664,771 A 9/1997 Nagatani et al.
6,234,470 B1 * 5/2001 Okitsu ..... B65H 3/5261 271/10.11
(Continued)

FOREIGN PATENT DOCUMENTS

CN 1817770 A 8/2006
JP H11-314774 A 11/1999
(Continued)

OTHER PUBLICATIONS

Search Report issued in corresponding International Patent Application No. PCT/JP2014/077249, dated Jan. 13, 2015.
(Continued)

*Primary Examiner* — Patrick Cicchino
(74) *Attorney, Agent, or Firm* — McDermott Will & Emery LLP

(57) ABSTRACT

A medium supplying apparatus includes a control unit. The control unit executes: a first control in which, in a case where a double feed detecting sensor detects a double feed of media, rotation drive of a separator roller is stopped, and a retard roller is caused to convey the media to an upstream side in a conveying direction; and a second control in which, after the execution of the first control, the rotation drive of the separator roller is restarted, and, in a case where the double feed detecting sensor detects a double feed of the media, a conveying load applied is set to be higher than that at the time of detecting the double feed before the execution of the first control, the rotation drive of the separator roller is stopped, and the retard roller is caused to convey the media to the upstream side in the conveying direction.

6 Claims, 10 Drawing Sheets

(51) Int. Cl.
*B65H 5/06* (2006.01)
*B65H 3/52* (2006.01)

(52) U.S. Cl.
CPC ..... *B65H 2301/4234* (2013.01); *B65H 2511/524* (2013.01); *B65H 2515/32* (2013.01)

(56) References Cited

U.S. PATENT DOCUMENTS

| | | | | |
|---|---|---|---|---|
| 6,672,579 | B2 * | 1/2004 | Araki | B65H 3/0669 271/121 |
| 6,913,257 | B2 | 7/2005 | Takaki et al. | |
| 7,234,695 | B2 * | 6/2007 | Tsukamoto | B65H 3/06 271/122 |
| 7,392,980 | B2 * | 7/2008 | Takeuchi | B65H 3/5261 271/10.01 |
| 7,658,374 | B2 | 2/2010 | Yasukawa et al. | |
| 7,905,484 | B2 * | 3/2011 | Komuro | B65H 3/0684 271/10.03 |
| 8,342,511 | B2 | 1/2013 | Takahashi | |
| 8,678,372 | B2 * | 3/2014 | Yasukawa | B65H 7/12 271/10.09 |
| 8,777,212 | B2 * | 7/2014 | Yasukawa | B65H 7/12 271/124 |
| 8,777,220 | B2 * | 7/2014 | Oshiro | B65H 3/0684 271/122 |
| 2005/0046102 | A1 | 3/2005 | Asari et al. | |
| 2005/0184447 | A1 | 8/2005 | Tsukamoto et al. | |
| 2006/0214356 | A1 | 9/2006 | Yasukawa et al. | |
| 2007/0126171 | A1 | 6/2007 | Takeuchi et al. | |
| 2009/0096153 | A1 * | 4/2009 | Katsura | B65H 1/04 271/10.11 |
| 2009/0184457 | A1 | 7/2009 | Tsukamoto et al. | |
| 2013/0001860 | A1 | 1/2013 | Oshiro et al. | |
| 2013/0241145 | A1 | 9/2013 | Yasukawa | |

FOREIGN PATENT DOCUMENTS

| | | | |
|---|---|---|---|
| JP | 2007-153560 | A | 6/2007 |
| JP | 2008-100828 | A | 5/2008 |
| JP | 4207796 | B2 | 1/2009 |
| JP | 4342249 | B2 | 10/2009 |
| JP | 2013-193837 | A | 9/2013 |
| JP | 5559843 | B2 | 7/2014 |

OTHER PUBLICATIONS

Office Action issued in corresponding Chinese Patent Application No. 201480082584.X, dated Aug. 24, 2017.

* cited by examiner

FIG.11

| PARAMETER | SYMBOL | SET VALUE (EXAMPLE) | UNIT |
|---|---|---|---|
| PERIPHERAL SPEED OF SEPARATOR ROLLER | $V_f$ | 700 | mm/s |
| REVERSE ROTATION PERIPHERAL SPEED OF RETARD ROLLER | $V_{re}$ | 300 | mm/s |
| DISTANCE BETWEEN NIP PART AND DOUBLE FEED DETECTING SENSOR | $L_0$ | 25 | mm |
| DISTANCE BETWEEN DOUBLE FEED DETECTING SENSOR AND FEED ROLLER | $L_{s\text{-}r}$ | 35 | mm |
| SEPARATOR ROLLER THROUGH-DOWN DISTANCE | $L_{td}$ | 10 | mm |

FIG.12

| NUMBER OF TIMES OF DETECTING DOUBLE FEED DURING SEPARATING SAME SHEETS n [TIMES] | RETARD ROLLER SHAFT TORQUE VALUE $T_n$ |
|---|---|
| ONCE | 50 [mN · m] |
| TWO TIMES | 70 [mN · m] |
| THREE TIMES | 80 [mN · m] |
| ⋮ | ⋮ |
| n TIMES | $T_n$ [mN · m] |

MEDIUM SUPPLYING APPARATUS

CROSS-REFERENCE TO RELATED APPLICATION

This application is a continuation of International Application No. PCT/JP2014/077249, filed on Oct. 10, 2014, the entire contents of which are incorporated herein by reference.

FIELD

The embodiment discussed herein is related to a medium supplying apparatus.

BACKGROUND

A medium supplying apparatus is an apparatus that separates one medium each time from a plurality of sheet-like media which are stacked and that supplies the separated medium and that is applied to an automatic document feeder mounted in an image forming apparatus such as a printer, an image reading apparatus such as a scanner, or the like. In such a medium supplying apparatus, it is necessary to separate and convey one medium at each time without causing double feed of media.

In such a medium supplying apparatus, in a case where a conveying error such as double feed occurs, a recovery operation for recovering the error, is performed by an operator. In the recovery operation, after opening a cover disposed at an error occurring spot and removing a medium that is the cause of the error, from the inside of the apparatus, the operator closes the cover and sets media again. Conventionally, in order to improve the efficiency of the recovery operation, a technology for performing control for automatically resolving a double feed in a case where the double feed occurs, is known (for example, Japanese Laid-open Patent Publication No. 2008-100828, Japanese Patent No. 4207796, Japanese Patent No. 4342249, and Japanese Patent No. 5559843).

Here, as an example of the control for automatically resolving a double feed in a case where the double feed occurs, for example, in Japanese Laid-open Patent Publication No. 2008-100828, a technology has been disclosed in which, when a double feed of sheet-like media is detected, in a state in which the retreat of an upper-side medium among a plurality of sheet-like media is prevented by using a reverse feed prevention member, a lower-side medium is returned according to reverse rotation of a retard roller.

However, in conventional technologies (Japanese Laid-open Patent Publication No. 2008-100828, Japanese Patent No. 4207796, Japanese Patent No. 4342249, and Japanese Patent No. 5559843, and the like), in a case where a double feed occurs, even when control for automatically resolving the double feed is performed, after a double feed state of a medium of which a double feed has been detected once is resolved, a situation in which a double feed is detected again for the same medium of which the double feed has been detected once may be considered to occur. The control according to the conventional technology is not a control process with such a situation being considered, and thus, there is room for further improvement in this point.

SUMMARY

According to an aspect of an embodiment, a medium supplying apparatus includes: a separator roller configured to convey media to a downstream side in a conveying direction by being driven to rotate in the conveying direction in which the media are conveyed; a retard roller that is disposed to face the separator roller and is configured to be driven to rotate in a direction opposite to the conveying direction while applying a predetermined conveying load to the media through a torque control mechanism; a double feed detecting sensor that is disposed on a downstream side of the separator roller and the retard roller in the conveying direction and is configured to detect a double feed of the media; and a control unit configured to control the separator roller and the retard roller, wherein the control unit executes: a first control in which, in a case where the double feed detecting sensor detects a double feed of the media, rotation drive of the separator roller is stopped, and the retard roller is caused to convey the media to an upstream side in the conveying direction; and a second control in which, after the execution of the first control, the rotation drive of the separator roller is restarted by cancelling the first control, and, in a case where the double feed detecting sensor detects a double feed of the media when the media are conveyed to the downstream side in the conveying direction, the conveying load applied by the torque control mechanism, is set to be higher than that at the time of detecting the double feed before the execution of the first control, the rotation drive of the separator roller is stopped, and the retard roller is caused to convey the media to the upstream side in the conveying direction.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

BRIEF DESCRIPTION OF DRAWINGS

FIG. 11 is a table that illustrates an example of set values of parameters in the medium supplying apparatus;

FIG. 12 is a table that illustrates an example of a relation between the number of times of detecting a double feed and the torque of a retard roller;

DESCRIPTION OF EMBODIMENTS

Hereinafter, a medium supplying apparatus according to an embodiment of the present disclosure will be described with reference to the drawings. The present disclosure is not limited to the embodiment described below. Each constituent element in the embodiment described below includes an element that can be easily considered by a person skilled in the art or a substantially same element. In the following drawings, a same reference sign is assigned to the same parts or parts corresponding to each other, and duplicate description thereof will not be presented.

Embodiment

Figure 1:
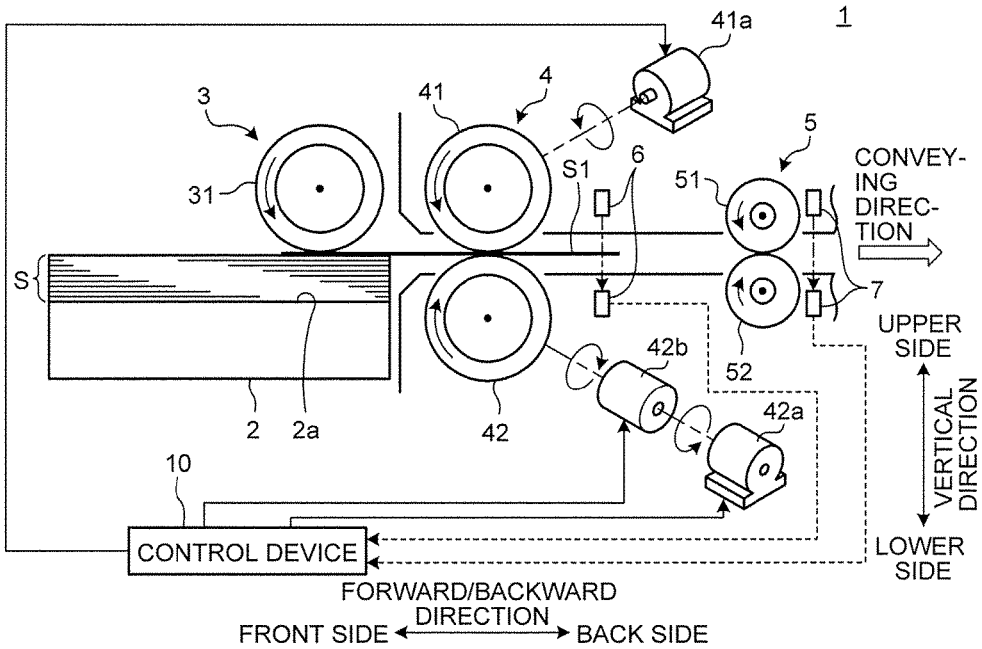
FIG. 1 is a diagram that illustrates the hardware configuration of a medium supplying apparatus according to an embodiment.
Figure 2:
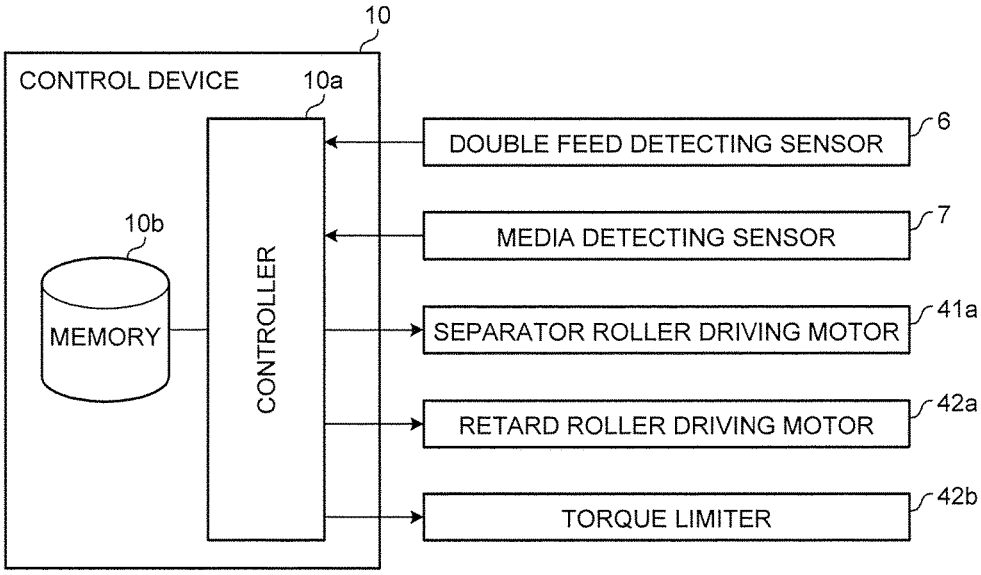
FIG. 2 is a functional block diagram of the medium supplying apparatus illustrated in FIG. 1.

First, the configuration of a medium supplying apparatus according to an embodiment will be described with reference to FIGS. 1 and 2. FIG. 1 is a diagram that illustrates the hardware configuration of a medium supplying apparatus according to an embodiment of the present disclosure. FIG. 2 is a functional block diagram of the medium supplying apparatus illustrated in FIG. 1.

As illustrated in FIG. 1, a medium supplying apparatus 1 according to this embodiment is a sheet feeding apparatus of a retard roller system that separates one medium S1 which is a conveying target at each time, from a plurality of media S stacked on a hopper 2 and that supplies the separated medium in a conveying direction. The medium supplying apparatus 1, for example, is applied to an automatic document feeder (ADF) mounted in an image reading apparatus such as an image scanner, a copying machine, a facsimile, or a text recognizing apparatus, an image forming apparatus such as a printer, and the like. In this embodiment, as an example, a case will be described in which the medium supplying apparatus 1 is mounted in an image reading apparatus and separates and conveys sheet-like media S. The media S and S1, for example, includes a sheet-like reading target object such as a document or a name card and a sheet-like recording medium such as a printing sheet or a paper sheet.

In the following description, a vertical direction and a horizontal direction in FIG. 1 will be described as the vertical direction and the forward/backward direction of the medium supplying apparatus 1, an upper side, a lower side, a left side, and a right side in FIG. 1, will be respectively described as the upper side, the lower side, the front side and the rear side of the medium supplying apparatus 1, and a perpendicular direction, in other words, a vertical direction in FIG. 1, will be described as a "vertical direction". In addition, a direction in which the medium S is to be conveyed by the medium supplying apparatus 1, will be described as a "conveying direction", a direction that is orthogonal to the conveying direction and the thickness direction of the medium S, will be described as a "width direction", and a thickness direction of the medium S that is orthogonal to the conveying direction and the width direction, will be described as a "height direction. In the example illustrated in FIG. 1, the front side of the medium supplying apparatus is the upstream side in the conveying direction, and the rear side is the downstream side in the conveying direction.

The medium supplying apparatus 1 at least includes: a hopper 2; a sheet feeding unit 3; a separation unit 4; a conveying unit 5; double feed detecting sensors 6; medium detecting sensors 7; and a control device 10.

The hopper 2 can load stacked media S and be lifted or lowered in the vertical direction (the thickness direction of the media S), and the hopper 2 includes a loading face 2*a* formed in an approximately rectangular shape. The hopper 2 loads a plurality of media S on the loading face 2*a* with being stacked. This hopper 2 is connected to a hopper driving motor (not illustrated in the drawing) through a power transmission mechanism not illustrated in the drawing. The hopper 2 is lifted or lowered in the vertical direction, in accordance with a load amount of the media S that is loaded on the loading face 2*a*, by driving the hopper driving motor.

The sheet feeding unit 3, the separation unit 4, and the conveying unit 5 are disposed on a conveying path for conveying a medium S1 that is a conveying target in the conveying direction with a predetermined gap interposed therebetween and are positioned in order of the sheet feeding unit 3, the separation unit 4, and the conveying unit 5 from the upstream side in the conveying direction toward the downstream side.

The sheet feeding unit 3 is a sheet feeding mechanism of a so-called upper-sheet taking feed system, and the sheet feeding unit 3 feeds a medium S loaded in the hopper 2, and includes a pick roller 31. The pick roller 31 feeds a medium S1 that is a conveying target positioned on an uppermost layer among media S loaded in the hopper 2 and, for example, and the pick roller 31 is formed in a columnar shape using a material such as foamed rubber or solid rubber having a high frictional force. The pick roller 31 is disposed in a direction orthogonal to the conveying direction of the medium S with a center shaft thereof being in approximately parallel with the width direction of the loading face 2*a*, in other words, following the loading face 2*a*. In addition, this pick roller 31 has the center shaft set to the side of the upper face of the hopper 2 (the loading face 2*a* side), and the pick roller 31 has an outer circumferential face thereof set to a position having a predetermined space from the loading face 2*a* of the hopper 2 along the height direction. The media S, on the loading face 2*a*, are loaded such that the rear ends (the upstream-side end portions in the conveying direction) of the media S are positioned on a further upstream side than the pick roller 31 in the conveying direction. The hopper 2 described above approaches the pick roller 31 by being lifted in the height direction, and the hopper 2 is separate away from the pick roller 31 by being lowered. In this embodiment, while the upper-sheet taking feed system is described as an example, the sheet feeding system is not limited thereto, but any other sheet feeding system such as a lower-sheet taking feed system may be applied.

In addition, this pick roller 31 is connected to a pick roller driving motor (not illustrated in the drawing) as a driving unit through a transmission gear or a belt not illustrated in the drawing, and the pick roller 31 is driven to rotate by a rotational drive force of the pick roller driving motor using the center shaft as rotation center. The pick roller 31 is driven to rotate in a picking direction, in other words, in a direction (a counterclockwise direction denoted by an arrow in FIG. 1) in which the outer circumferential face faces the side of the separation unit 4 and the conveying unit 5 on the loading face 2*a*.

The separation unit 4 separates media S fed from the hopper 2 by the sheet feeding unit 3 one at each time and includes a separator roller 41 and a retard roller 42. The separator roller 41, for example, is formed in a columnar shape using a material such as foamed rubber or solid rubber having a high frictional force. The separator roller 41 is disposed on the downstream side of the pick roller 31 in the conveying direction in approximately parallel with the pick roller 31. In other words, the separator roller 41 is disposed in a direction orthogonal to the conveying direction of the medium S with a center shaft thereof following the loading face 2*a*. In addition, this separator roller 41 has the center shaft thereof set to the side of the upper face of the hopper 2, and the separator roller 41 has the outer circumferential face set to a position having a predetermined space from the loading face 2*a* of the hopper 2 in the height direction. This separator roller 41 is connected to a separator roller driving motor 41*a* through a transmission gear or a belt not illustrated in the drawing, and the separator roller 41 is driven to rotate according to a rotation drive force of the separator roller driving motor 41*a* by using the center shaft as rotation center. The separator roller 41, similar to the pick roller 31, is driven to rotate in a direction (a counterclockwise direction denoted by an arrow in FIG. 1) in which the outer circumferential face faces the conveying unit 5 side on the loading face 2*a*.

In this embodiment, a one-way clutch (rotation regulating unit) not illustrated in the drawing is provided to the separator roller 41. The one-way clutch is disposed to allow the separator roller 41 to rotate in a conveying rotation direction for conveying a medium S1 that is a conveying target in the conveying direction and is disposed to regulate the rotation thereof in a rotation direction opposite to the conveying rotation direction. As a specific configuration of the one-way clutch, for example, a configuration of a roller type, a cam type, a coil spring type, a ratchet type, a sprag type, or the like may be applied. In addition, a configuration may be employed in which a support member such as a sintered bearing, a resin bearing, a ball bearing, or the like is disposed on both sides of the one-way clutch in the axial direction, and the radial weight applied to the one-way clutch is supported.

The retard roller 42 regulates the feed of media S other than a medium S1, which is a conveying target, that is directly brought into contact with the pick roller 31. The retard roller 42 has a length that is almost the same as the separator roller 41 and is formed in a columnar shape. The retard roller 42, similar to the separator roller 41, is disposed such that the center shaft thereof horizontally intersects with the conveying direction of a medium S, in other words, follows the width direction of a medium S, and the retard roller 42 is disposed to be rotatable using the center shaft as an axis of rotation. The retard roller 42 is disposed to face the separator roller 41 so as to be brought into contact therewith in the height direction on the loading face 2*a* side. In this embodiment, the retard roller 42 has a function of applying a predetermined conveying load to a medium S which entered between the separator roller 41 and the retard roller by being driven to rotate in a direction opposite to the rotation drive direction of the separator roller 41, and the retard roller 42 is configured to stop and separate a medium S accompanied with the feed of the medium S1 of the uppermost layer using the sheet feeding unit 3. In other words, the retard roller 42 functions as a roller used for preventing a medium S other than one medium S1 that is a conveying target among a plurality of media S stacked on the hopper 2 from being fed in the conveying direction.

More specifically, the retard roller 42 is connected to a retard roller driving motor 42*a* through a torque limiter 42*b* as a torque control mechanism, and the retard roller 42 is driven to rotate according to the rotation drive force of the retard roller driving motor 42*a* using the center shaft as a rotation center. As described above, the retard roller 42 needs to be controlled to be driven in a direction opposite to the conveying direction while having a constant conveying load (idling torque). For this reason, as the torque control mechanism according to this embodiment, for example, a DC motor or a brushless DC motor is preferable. For the DC motor or the brushless DC motor, a current and torque have a proportional relation, and the controllability of reverse rotation torque is superior, and the DC motor or the brushless DC motor is a member that is appropriate for the control simultaneously performing reverse-direction rotation drive and torque control of the retard roller 42. In addition, as the torque control mechanism, a hysteresis brake or a micro powder clutch may be employed.

More specifically, the retard roller 42 includes: a center shaft disposed to be approximately orthogonal to the conveying direction; and a roller as an outer circumferential face disposed on the periphery of the center shaft. This roller, for example, is formed in a columnar shape by using a soft material that can be used for easily forming a nip width, such as foaming rubber, solid rubber, or the like in an inner layer. The roller of the retard roller 42 is pressed to be in contact with the roller as the outer circumferential face of the separator roller 41. Accordingly, between the outer circumferential face of the retard roller 42 and the outer circumferential face of the separator roller 41, a nip part that is a contact face between the separator roller 41 and the retard roller 42, is formed. A medium S passes through the nip part between the separator roller 41 and the retard roller 42, and the medium S is fed to the downstream side in the conveying direction.

The retard roller 42 is configured to be driven to rotate according to the rotation of the separator roller 41 at the time of receiving torque of predetermined driven-rotation torque or more from the separator roller 41 and to generate a predetermined rotation load at the time of receiving torque less than the driven-rotation torque from the separator roller 41. Such a configuration can be realized by using the center shaft driven to rotate according to a rotation drive force of the retard roller driving motor 42*a* as the drive shaft and rotating this shaft in a direction opposite to the conveying direction to generate a conveying load.

Figure 4:
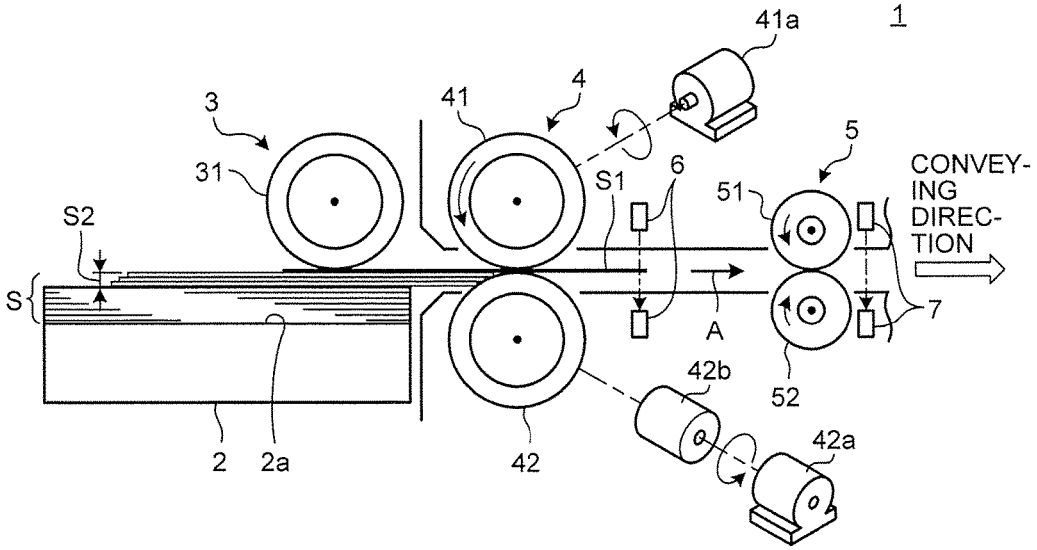
FIG. 4 is a diagram that illustrates an example of the operation of the medium supplying apparatus according to the embodiment.

For example, in a case where only one medium S enters the nip part, as illustrated in FIG. 1 described above, the retard roller 42 is driven to rotate by receiving torque of the driven-rotation torque or more. On the other hand, in a case where another medium S is doubly fed and enter the nip part, the friction coefficient of the nip part becomes relatively small, and accordingly, as illustrated in FIG. 4 to be described later, the rotation drive of the separator roller 41 is stopped, and one medium S1 that is the conveying target is stopped and maintained by the separator roller 41 in which the one-way clutch is disposed. In addition, by stopping the rotation drive of the separator roller 41, a rotation load is generated in the retard roller 42, and the medium S entering the nip part other than the medium S1 disposed on the separator roller 41 side, is relatively moved with respect to the medium S1 that is the conveying target, and is separated. Then, by sending out only the medium S1 that is the conveying target from the nip part and maintaining the other medium S inside the nip part, it can be prevented that the medium S other than one medium S1, which is the conveying target, is continuously fed in the conveying direction. In this embodiment, the magnitude of the rotation load generated by the retard roller 42 and the magnitude of the conveying load applied to the medium S generated according thereto, can be adjusted by the torque limiter 42*b* as a torque control mechanism.

Here, an example of a condition for separating one medium according the control torque of the retard roller 42, will be described. As this condition, the rotation load according to the control torque of the retard roller needs to be larger than a frictional force between sheets. When a control torque value according to the torque limiter 42*b* is denoted by $T_L$, the radius of the retard roller is denoted by r, the rotation load of the retard roller is denoted by $F_B \approx T_L/r$, the load of the retard roller is denoted by W, and the friction coefficient between sheets is denoted by $\mu_{p\text{-}p}$, $F_B > \mu_{p\text{-}p} \cdot W$, and accordingly, $T_L > \mu_{p\text{-}p} \cdot W \cdot r = T_{min}$. Accordingly, the control torque of the retard roller 42 needs to be higher than this $T_{min}$.

In addition, an example of a condition for which the retard roller 42 is driven to rotate when one medium is conveyed will be described. In order to convey one sheet using a roller pair of the separation unit 4, it is necessary for the retard roller 42 to be driven to rotate (rotated in the conveying direction) by the separator roller 41 through the sheet. In a case where the retard roller 42 slips (reverse rotation) over a sheet, the conveying of the sheet becomes unstable, and a jam or a damage is caused at the time of conveyance, and it is necessary to avoid the slip. A condition for the retard roller 42 to be driven to rotate at the time of conveying one sheet is a condition, in which the rotation load according to the control torque of the retard roller is lower than a friction load between the retard roller 42 and the sheet. When the friction coefficient between the retard roller 42 and the sheet is denoted by $\mu_{ret\text{-}p}$, $\mu_{ret\text{-}p} \cdot W > F_B$, and thus, $T_L < \mu_{ret\text{-}p} \cdot W \cdot r = T_{max}$. Accordingly, the control torque of the retard roller needs to be lower than this $T_{max}$. In addition, as a condition of the load torque for not causing a thin sheet jam or a damage, generally, control torque that is slightly higher than $T_{min}$ described above, is considered to be a limit point for the occurrence of a jam. Naturally, based on the thickness, the rigidity, and the state of the thin sheet, the sheet feeding mechanism, and the like, schematically, as will be represented in FIG. 16 to be described later, there is a relation of $T_{min} < T_{jam} \ll T_{max}$.

The conveying unit 5 conveys a medium S1, which has been fed by the sheet feeding unit 3 and which has passed through the separation unit 4, to each unit of an apparatus, in which this medium supplying apparatus 1 is mounted, disposed on a further downstream side in the conveying direction. On the downstream side of the conveying unit 5 in the conveying direction, for example, in a case where this medium supplying apparatus 1 is mounted in an image reading apparatus, an optical unit as an image reading unit, which reads an image formed on the medium S1, and the like are disposed, and thus, the image is read by the optical unit from the medium S1, which are conveyed to the inside of the image reading apparatus by the conveying unit 5.

More specifically, the conveying unit 5 includes: a feed roller 51 that can be driven to rotate; and a driven roller 52 that can be rotated by being driven by the feed roller 51. The feed roller 51 and the driven roller 52 have almost same lengths and are formed in a columnar shape. The feed roller 51 and the driven roller 52 are disposed such that the center shafts thereof horizontally intersect with the conveying direction of the medium S1, in other words, follows the width direction of the medium S1 and are disposed to be rotatable using the center shaft as a rotation axial line. The driven roller 52 is disposed to face the feed roller 51 so as to be brought into contact therewith, and the driven roller 52 is pressed to the feed roller 51 side so as to be brought into contact therewith.

In order for the feed roller 51 to convey the medium S1, the outer circumferential face of the feed roller 51 is driven to rotate on a contact face with the driven roller 52, from the separation unit 4 side in a direction (the counterclockwise direction denoted by then arrow in FIG. 1) toward the inside of the apparatus to which the medium supplying apparatus 1 is applied. By pressing the driven roller 52 to the feed roller 51 so as to be brought into contact therewith, the driven roller 52 follows the rotation of the feed roller 51, the outer circumferential face of the driven roller 52 is driven to rotate on a contact face with the feed roller 51, from the separation unit 4 side in a direction (a clockwise direction denoted by an arrow in FIG. 1) toward the inside of the apparatus. Then, this conveying unit 5, according to the negative pressure of the driven roller 52, pinches the medium S1 between the outer circumferential face of the feed roller 51 and the outer circumferential face of the driven roller 52, and the feed roller 51 is driven to rotate as described above, whereby the medium S1 is conveyed. The medium S1 is sequentially transferred between roller pairs of a plurality of feed roller (not illustrated in the drawing) and a plurality of driven rollers (not illustrated, in the drawing) disposed along the conveying path and accordingly, is conveyed to each unit disposed inside the apparatus to which the medium supplying apparatus 1 is applied, for example, is conveyed to the optical unit described above.

In addition, the feed roller 51 described above is connected to a feed roller driving motor (not illustrated in the drawing) through a transmission gear or a belt not illustrated in the drawing. Here, the rotation speed of the feed roller 51 is adjusted by the transmission gear or the like, and accordingly, the feed roller 51 is driven to rotate at a relatively high rotation speed compared to the rotation speeds of the pick roller 31 and the separator roller 41. In other words, the conveying unit 5 can convey a medium S1 separated by the separation unit 4 at a speed higher than the speed of the medium S1 fed by the sheet feeding unit 3. However, the conveying unit 5 is not limited thereto but may convey the medium S1 at a speed equivalent to the speed of the medium S1 fed by the sheet feeding unit 3.

The double feed detecting sensors 6 detect a double feed of media S1 on the conveying path. The double feed detecting sensors 6 are disposed on the conveying path of the medium S1 and detect a double feed state in which media S1 are simultaneously fed. The double feed detecting sensors 6 are disposed at arbitrary positions between the separation unit 4 and the conveying unit 5. The arrangement positions of the double feed detecting sensors 6 according to this embodiment will be described in detail later with reference to FIGS. 6 and 7. One pair of the double feed detecting sensors 6 are disposed with the conveying path of the medium S1 interposed therebetween, and the double feed detecting sensors 6 face each other along the thickness direction of the medium S1. Then, the double feed detecting sensors 6 detect the passage of a plurality of media S in a double feed state in which the plurality of media S are simultaneously fed between the sensors facing each other. As a detection system for the double feed detecting sensor 6, a detection system using ultrasonic waves, a detection system using an optical sensor, a detection system using infrared rays, or the like may be applied, but the detection system is not limited thereto.

The medium detecting sensors 7 detect presence/absence of a medium S1 on the conveying path. The medium detecting sensors 7 are disposed on the conveying path of the medium S1 and detect passage of a front end of a medium S1. The medium detecting sensors 7 are disposed immediately after the conveying unit 5 in the conveying direction. In this embodiment, one pair of the medium detecting sensors 7 are disposed with the conveying path of the medium S1 interposed therebetween, and the medium detecting sensors 7 face each other in the thickness direction of the medium S1. Then, the medium detecting sensors 7 detect the passage of a medium S1 between the sensors facing each other. The medium detecting sensors 7 may be disposed at arbitrary positions such as upstream (for example, immediately before the conveying unit 5) of the conveying unit 5 as long as it can detect the entrance of the medium S1 into the conveying unit 5. As the detection system for the medium detecting sensors 7, a detection system using ultrasonic waves, a detection system using an optical sensor, a detection system using infrared rays, or the like may be applied, but the detection system is not limited thereto. In addition, while not illustrated in FIG. 1, in the medium supplying apparatus 1, in order to detect the entrance of a medium S into a nip part that is a contact face of the separator roller 41 of the separation unit 4 and the retard roller 42, the medium detecting sensors 7 may be disposed near (for example, immediately before the separation unit 4) the separation unit 4.

The control device 10 controls each unit of the medium supplying apparatus 1. As illustrated in FIG. 2, various sensors such as the double feed detecting sensors 6 and the medium detecting sensors 7 described above, various drive motors such as the separator roller driving motor 41*a* and the retard roller driving motor 42*a* described above, and various control mechanisms such as the torque limiter 42*b*, and the like are electrically connected to the control device 10. The control device 10 receives information from various sensors such as the double feed detecting sensors 6 and the medium detecting sensors 7. The control device 10 drives rollers of the sheet feeding unit 3, the separation unit 4, and the conveying unit 5 and the hopper 2 by controlling various drive motors such as the separator roller driving motor 41*a* and the retard roller driving motor 42*a*, and various control mechanisms such as the torque limiter 42*b*, and the like and thereby performing control of resolving a double feed state by conveying a medium S1 that is a conveying target in the conveying direction or by returning a medium S1 in a direction opposite to the conveying direction at the time of detecting a double feed. The control of resolving the double feed state will be described later in detail.

The control device 10 at least includes: a controller 10*a* as a control unit; and a memory 10*b* as a storage unit. More specifically, the control device 10 is a computer that includes a central processing unit (CPU), a graphic processing unit (GPU), a digital signal processor (DSP), a large scale integrated circuit (LSI), an application specific integrated circuit (ASIC), and/or a field-programing gate array (FPGA), functioning as the material controller 10*a* performing various processes, or includes a control circuit. The control device 10 is a computer that includes a random access memory (RAM) and a read only memory (ROM) functioning as the memory 10*b*, a fixed disk drive such as a hard disk drive, a solid state drive (SSD), and/or an optical disk, storing various kinds of information, and the like. All or a part of functions of the control device 10 described above are realized by reading/writing data from/into the RAM or the ROM by loading an application program stored in the ROM into the RAM and executing the application program using the CPU. In this embodiment, in the memory 10*b*, for example, image data of a medium S read by the optical unit as the image reading unit described above, data of the number of times of detecting a double feed (the number of times of double feed detecting) for a same medium S using the double feed detecting sensors 6, set values of various parameters, and the like are stored.

In this embodiment, the controller 10*a* is configured to control the separator roller 41 and the retard roller 42. For example, in other words, a digital signal processor is configured to control the separator roller 41 and the retard roller 42. The controller 10*a* as the control unit executes a first control for stopping rotation drive of the separator roller 41 and causing the retard roller 42 to convey a medium S to the upstream side in the conveying direction in a case where the double feed detecting sensors 6 detect a double feed of the medium S.

More specifically, in this first control, in a case where a control signal representing detection of a double feed state is received from the double feed detecting sensor 6, the controller 10*a* transmits a control signal, which is used for stopping rotation drive, to the separator roller driving motor 41*a*, thereby stopping the rotation drive of the separator roller driving motor 41*a*. Accordingly, torque applied to the retard roller 42 from the separator roller 41, in which the one-way clutch is disposed, which is in the stopped state, is lower than predetermined driven-rotation torque, and thus, according to a rotation drive force generated by the retard roller driving motor 42*a*, the retard roller 42 is driven to rotate in a direction opposite to the rotation drive direction of the separator roller 41. As a result, by the retard roller 42, a medium S, which enters the nip part, other than the medium S1 that is a conveying target disposed on the separator roller 41 side, is relatively moved with respect to the medium S1 that is the conveying target, and the medium S is separated. The operation of the medium supplying apparatus 1 performed when this first control is executed, will be described later in detail with reference to FIGS. 5 and 6 and FIGS. 8 and 9.

Next, the operation of the medium supplying apparatus 1 according to this embodiment, will be described with reference to FIGS. 3 to 10. FIGS. 3 to 6 and FIGS. 8 to 10 are diagrams that illustrate an example of the operation of the medium supplying apparatus 1 according to the embodiment. FIG. 7 is a graph that illustrates an example of the arrangement positions of the double feed detecting sensors 6 in the medium supplying apparatus 1.

Figure 3:
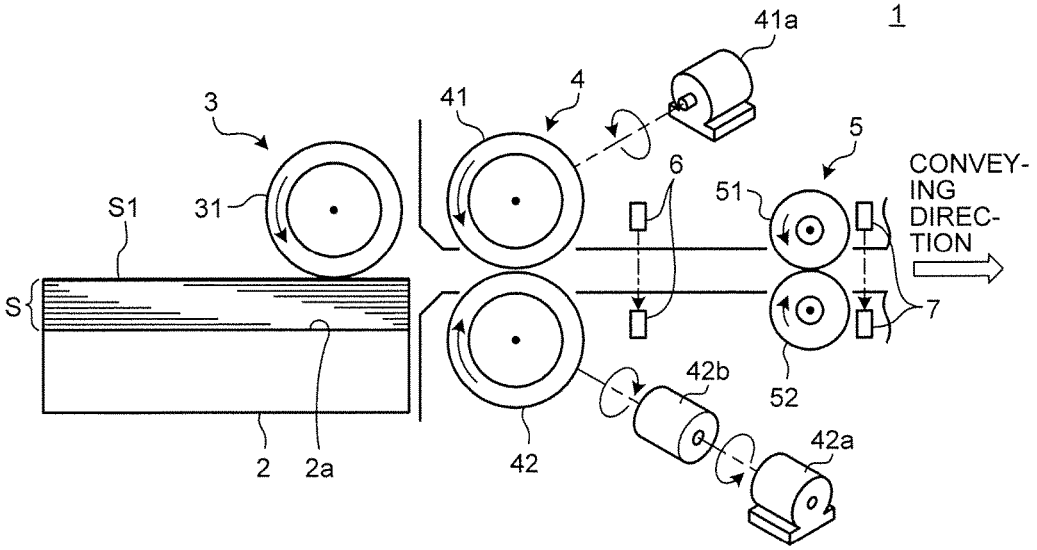
FIG. 3 is a diagram that illustrates an example of the operation of the medium supplying apparatus according to the embodiment.

In the medium supplying apparatus 1 illustrated in FIG. 3, a medium S1, which is a conveying target, is in a state immediately before being picked by the pick roller 31 from a plurality of sheet-like media S stacked on the hopper 2. At this time, since it is not checked that at least a part of a medium S arrives at the separation unit 4 by medium detecting sensors (not illustrated in the drawing) disposed near the nip part of the separation unit 4, the pick roller 31 is driven to rotate in the conveying direction by a pick roller driving motor (not illustrated in the drawing). The separator roller 41 is driven to rotate in the conveying direction in accordance with a rotation drive force of the separator roller driving motor 41*a*. Here, in the state illustrated in FIG. 3, in order to separate one medium S1 that is the conveying target from the sheet-lime media S when a plurality of the media are fed by the pick roller 31, the retard roller 42 is controlled to have an idling load (load torque) that is appropriate for separating one medium from the sheet-like media S and is controlled to be driven to reversely rotate in a direction for returning the medium S. The reverse-direction idling torque of the retard roller 42 at this time is controlled to be idling torque within a predetermined appropriate range (a state illustrated in FIG. 4 to be described later) such that the retard roller 42 is driven to rotate in the conveying direction (the state illustrated in FIG. 1 described above) when one medium S1 is conveyed to the nip part of the separation unit 4, and such that the retard roller 42 induces slip between an excess medium S and one medium S1 that is the conveying target when two or more media are conveyed to the nip part. In the state illustrated in FIG. 3, the retard roller 42 is in the state of being driven to rotate by the separator roller 41, and is in a state waiting for a medium S that is fed by the pick roller 31. In addition, the feed roller 51 and the driven roller 52 are driven to rotate in the conveying direction in accordance with a rotation drive force of a feed roller driving motor (not illustrated in the drawing). In addition, in this embodiment, in a case where the medium S1 is determined to have passed the nip part, which is a contact face of the feed roller 51 and the driven roller 52, by the medium detecting sensors 7, while rotation drive of the separator roller 41 in the conveying direction is stopped, until then, the separator roller 41 is constantly driven to rotate in the state after FIG. 3.

The medium supplying apparatus 1 illustrated in FIG. 4, from the state illustrated in FIG. 3 described above, becomes a state in which one medium S1, which is a conveying target, and three media S2, which are positioned on a layer lower than the medium S1 among a plurality of sheet-like media S stacked on the hopper 2, are picked by the pick roller 31, and one medium S1 and three media S2 arrive at the nip part of the separation unit 4, and then, only one medium S1, which is the conveying target, is normally separated by the separation unit 4. At this time, it is checked, by the medium detecting sensors (not illustrated in the drawing) disposed near the nip part of the separation unit 4, that some (the medium S1 and the media S2 in FIG. 4) of the media S already arrive at the separation unit 4, and accordingly, the pick roller 31 is stopped. The separator roller 41 is driven to rotate in the conveying direction in accordance with the rotation drive force of the separator roller driving motor 41*a*. While the retard roller 42 is driven to rotate in a direction opposite to the conveying direction in accordance with the rotation drive force of the retard roller driving motor 42*a*, the retard roller 42 is controlled to idling torque within a predetermined appropriate range so as to induce slip between an excess medium S and one medium S1, which is the conveying target, when two or more media S are conveyed to the nip part as described above, and accordingly, the retard roller 42 is in a stopped state. In the state illustrated in FIG. 4, the medium S1, which is the conveying target, is conveyed in a direction (in other words, the conveying direction) denoted by an arrow A.

Figure 5:
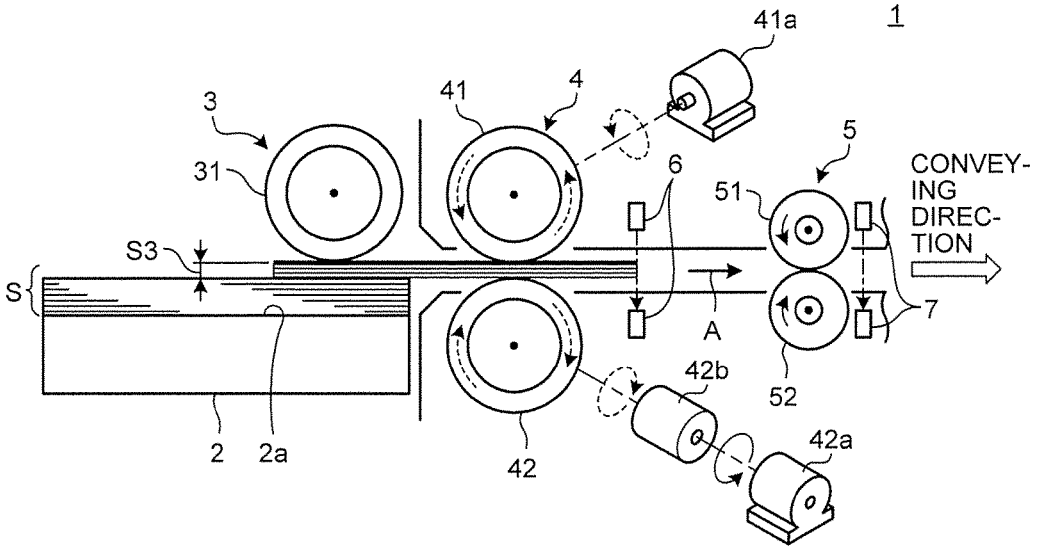
FIG. 5 is a diagram that illustrates an example of the operation of the medium supplying apparatus according to the embodiment.

The medium supplying apparatus 1 illustrated in FIG. 5, from the state illustrated in FIG. 3 described above, becomes a state in which media S3, which include one medium S1 and three media S2 described above among the plurality of sheet-like media S staked on the hopper 2, are picked by the pick roller 31 and the media S3 arrive at the nip part of the separation unit 4, and then, different from the state illustrated in FIG. 4 described above, the media S3 pass through the nip part of the separation unit 4 in a double feed state. At this time, it is checked, by the medium detecting sensors (not illustrated in the drawing) disposed near the nip part of the separation unit 4, that some (the media S3 in FIG. 5) of the media S already arrive at the separation unit 4, and accordingly, the pick roller 31 is stopped. In addition, since it is checked, by using the double feed detecting sensor 6, that the media S3 are in the double feed state, the rotation drive of the separator roller driving motor 41*a* is controlled to be decelerated, and the rotation drive of the separator roller 41 in the conveying direction is in a slow-down state in accordance therewith. The torque applied from the separator roller 41, which is in the slow-down state, to the retard roller 42 through the media S3 decreases, and accordingly, in accordance with this, the rotation drive in the conveying direction according to the following rotation of the retard roller 42, is also in the slow-down state. In the state illustrated in FIG. 5, while the media S3 are conveyed in a direction (in other words, the conveying direction) denoted by an arrow A, the conveying speed of the media S3 is decreased.

Figure 6:
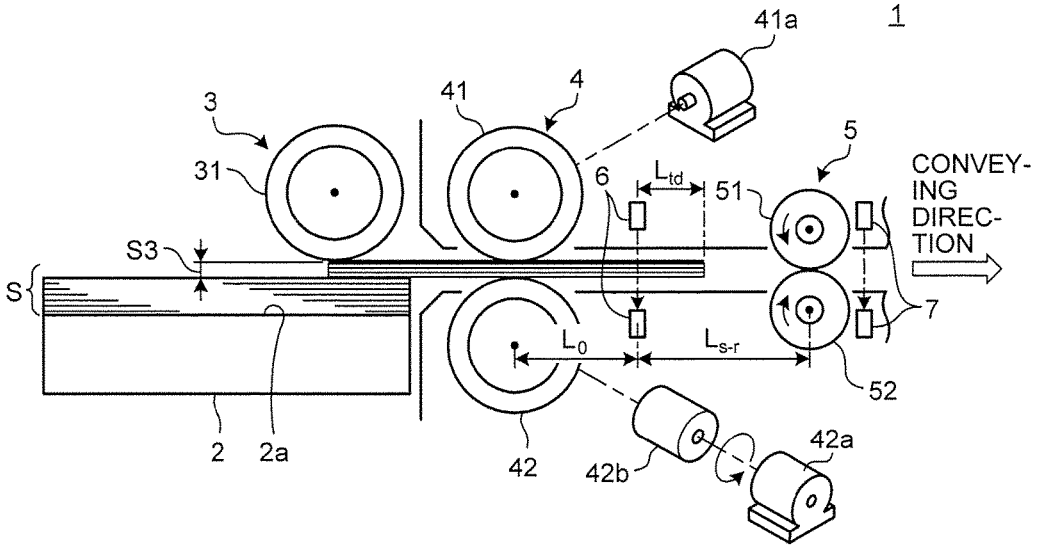
FIG. 6 is a diagram that illustrates an example of the operation of the medium supplying apparatus according to the embodiment.
Figure 7:
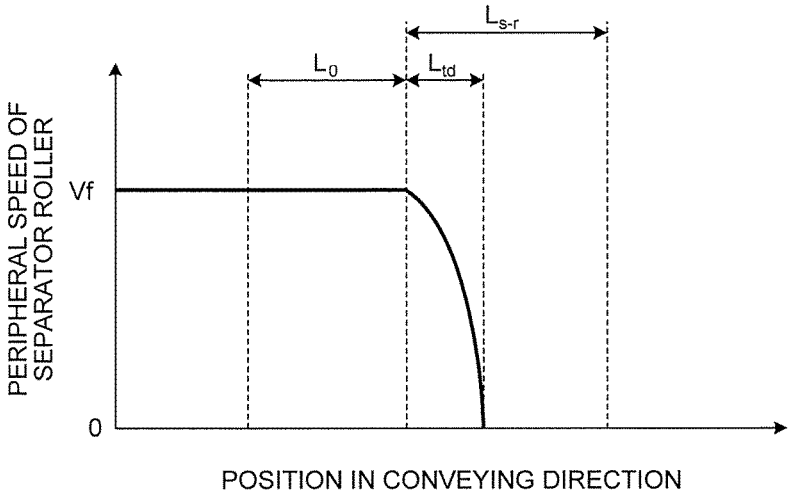
FIG. 7 is a graph that illustrates an example of the arrangement positions of double feed detecting sensors in the medium supplying apparatus.

The medium supplying apparatus 1 illustrated in FIG. 6, from the state illustrated in FIG. 5 described above, becomes a state in which the separator roller 41 and the retard roller 42 are completely stopped. At this time, the pick roller 31 is also stopped. In the states illustrated in FIGS. 6 and 7, a distance from the nip part, which is a contact face of the separator roller 41 of the separation unit 4 and the retard roller 42, to the double feed detecting sensor 6 is assumed to be $L_0$. In addition, a distance from the double feed detecting sensor 6 to the nip part, which is a contact face between the feed roller 51 and the driven roller 52, is assumed to be $L_{s\text{-}r}$. A slow-down distance from the double feed detecting sensor 6 is assumed to be $L_{td}$. FIG. 7 illustrates an appearance in which the peripheral speed $V_f$ of the separator roller 41 is slow-down after the detection of a double feed, and the front ends of the media S3 on the conveying-direction side are stopped at a conveying direction position at which the peripheral speed $V_f$ becomes zero. In other words, in the states illustrated in FIGS. 6 and 7, the front ends of the media S3 on the conveying-direction side are stopped at a position moved from the arrangement position of the double feed detecting sensor 6 by the slow-down distance $L_{td}$ in the conveying direction after the detection of the double feed.

Here, in order to stop the separator roller driving motor 41*a* that controls the driving of the separator roller 41, as illustrated in FIG. 5 described above, deceleration control is generally performed. For example, in a case where the separator roller driving motor 41*a* is a stepping motor, in order to perform stop control of the separator roller driving motor 41*a* from a constant-speed state to a zero-speed state, the pulse rate is decreased based on a predetermined slow-down table (slow-down pulse). Accordingly, the front ends of a plurality of the media S3 in the double feed state are conveyed from the double feed detecting sensor 6 to the downstream side by this distance. This distance is the slow-down distance $L_{td}$.

This slow-down distance $L_{td}$ is required to be shorter than the distance $L_{s\text{-}r}$ described above ($L_{td}<L_{s\text{-}r}$). The reason for this is for preventing the media S3 from being further conveyed by the feed roller 51 to the next process in the double feed state, as a result of the conveying of the media S3 that is checked by using the double feed detecting sensor 6 to be in the double feed state to the downstream side by the slow-down distance $L_{td}$. In addition, since a sheet group such as the media S3 that may be easily doubly fed, are in a sheet state in which the media S3 are difficult to separate, and a case may be considered in which re-separation control performed once is not enough, and a double feed is detected again during the conveying of the same sheets. For example, for sheets having a high friction coefficient between sheets that are in contact with each other, or for coated paper sheets of high smoothness that may easily adhere together due to static electricity or the like, even in a case where re-separation control is performed after a double feed is detected once, there is a possibility that a double feed is detected again. In order to perform reliable re-separation also for such sheets that are difficult to separate, like second control to be described later, in a case where a second double feed is detected for same sheets, it is effective to set the torque to be higher than the load torque of the retard roller 42 applied in the reverse direction at the time of detecting a first double feed. In order to enable more stable re-separation in a case where a second double feed is detected, the arrangement position of the double feed detecting sensor 6 is preferably a position that is separate away toward the upstream side of the feed roller 51 by a distance that is twice the slow-down distance $L_{td}$ (deceleration distance) according to the slow-down control of the separator roller 41 or more (conditional expression: $L_{s-r}>2\times L_{td}$). For example, as illustrated in FIG. 11 to be described later, the conditional expression is satisfied also in a case where the distance $L_{s-r}$ between the double feed detecting sensor 6 and the feed roller 51 is 35 mm, and the slow-down distance $L_{td}$ of the separator roller 41 is 10 mm.

Figure 8:
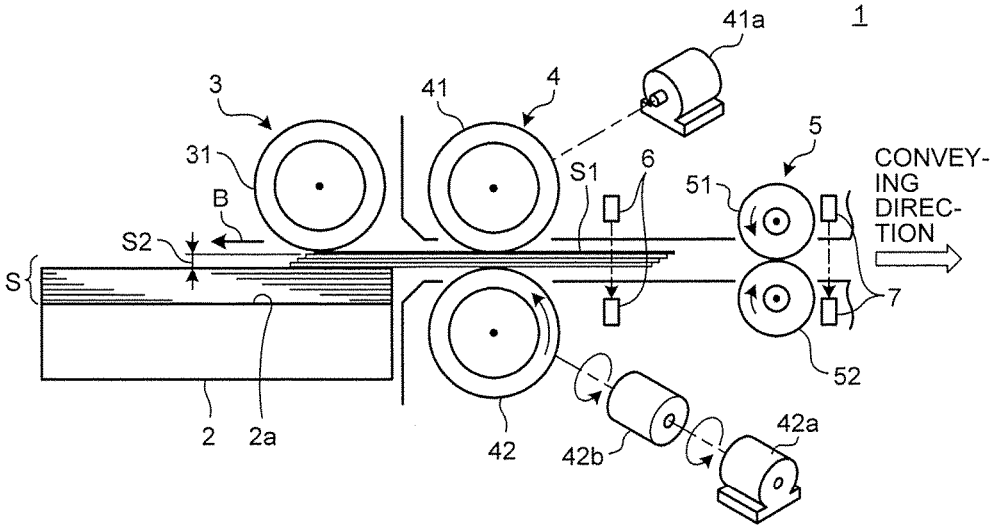
FIG. 8 is a diagram that illustrates an example of the operation of the medium supplying apparatus according to the embodiment.

The medium supplying apparatus 1 illustrated in FIG. 8, from the state illustrated in FIG. 6 described above, becomes a state in which the retard roller 42 is driven to rotate in a direction opposite to the conveying direction in accordance with the rotation drive force of the retard roller driving motor 42*a* in the stopped state of the separator roller 41. At this time, only the medium S1, which is the conveying target, is maintained to be stopped by the separator roller 41, and the media S2, which are excess media, are returned in the direction opposite to the conveying direction. In the state illustrated in FIG. 8, the excess media S2 are conveyed in a direction (the direction opposite to the conveying direction) denoted by an arrow B.

Figure 9:
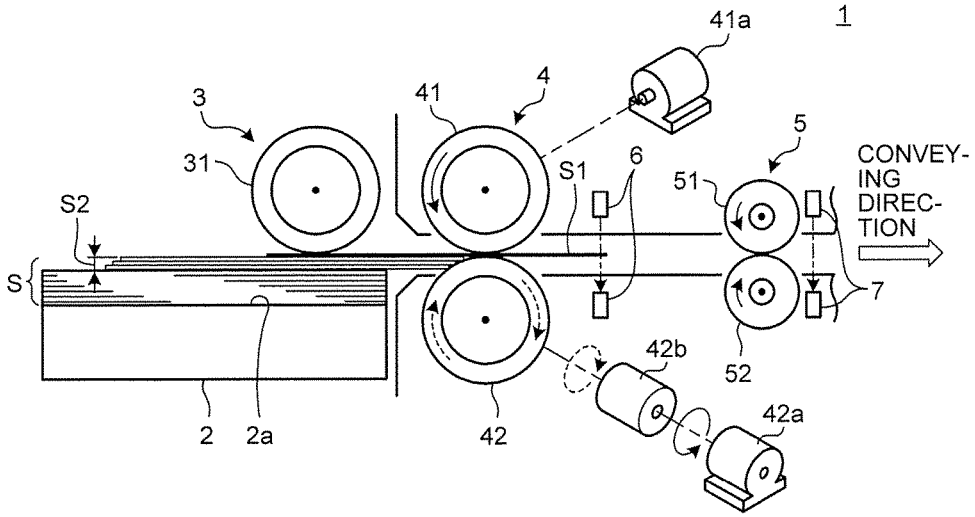
FIG. 9 is a diagram that illustrates an example of the operation of the medium supplying apparatus according to the embodiment.

The medium supplying apparatus 1 illustrated in FIG. 9, from the state illustrated in FIG. 8 described above, becomes a state in which all the excess media S2 are returned from the nip part of the separation unit 4 to the upstream side. At this time, the double feed detecting sensor 6 detects one medium S1 and checks that the double feed state is resolved. For this reason, again, in order to convey the medium S1 in the conveying direction, it is necessary to cancel the execution of this control (the first control described above). Thus, by restarting the rotation drive of the separator roller 41 by controlling the separator roller driving motor 41*a*, the retard roller 42, similar to the separator roller 41, is started to be driven to rotate in the conveying direction.

Here, referring back to FIG. 2, in this embodiment, after the execution of the first control described above, the controller 10*a* as the control unit restarts the rotation drive of the separator roller 41 by cancelling the first control and, in a case where the double feed detecting sensor 6 detects a double feed of the media S when the medium S is conveyed to the downstream side in the conveying direction, the controller 10*a* sets the conveying load, which is applied by the torque limiter 42*b* as the torque control mechanism, to be higher than that at the detection of the double feed before the execution of the first control, and then the controller 10*a* stops the rotation drive of the separator roller 41 and executes second control for causing the retard roller 42 to convey the medium S to the upstream side in the conveying direction.

More specifically, in this second control, after the execution of the first control described above, in a case where a control signal, which represents that the double feed state is resolved, is received from the double feed detecting sensor 6, the controller 10*a* transmits a control signal used for restarting the rotation drive to the separator roller driving motor 41*a*, thereby restarting the rotation drive of the separator roller driving motor 41*a*. Accordingly, torque applied to the retard roller 42 from the separator roller 41 is the driven-rotation torque or more, and accordingly, the retard roller 42 receives torque of the driven-rotation torque or more, and the retard roller 42 is driven to rotate. As a result, the medium S passes through the nip part between the separator roller 41 and the retard roller 42, and the medium S is fed to the downstream side in the conveying direction. Then, at this time, again, in a case where the controller 10*a* receives a control signal, which represents that a double feed state is detected, from the double feed detecting sensor 6, the controller 10*a* sets a current for controlling torque to be applied to the torque limiter 42*b* to a value higher than that at the time of detecting a double feed before the execution of the first control, and the controller 10*a* changes a rotation load generated by the retard roller 42 to be larger than that at the time of executing the first control. In that state, the controller 10*a* transmits a control signal used for stopping the rotation drive to the separator roller driving motor 41*a*, thereby stopping the rotation drive of the separator roller driving motor 41*a*.

Accordingly, in the second control, torque applied from the separator roller 41, in which the one-way clutch is disposed, that is in the stopped state to the retard roller 42, is relatively smaller than that at the time of executing the first control based on the changed rotation load of the retard roller 42. Accordingly, when the retard roller 42 is driven to rotate in the direction opposite to the rotation drive direction of the separator roller 41, a conveying load applied to the medium S is larger than that at the time of executing the first control. As a result, by using the retard roller 42, media entering the nip part other than the medium S1, which is the conveying target and is disposed on the separator roller 41 side, are separated more appropriately than in the first control. In this way, even in a case where, after a double feed state of the media S from which a double feed is detected once is resolved, a double feed is detected again for the same media S from which the double feed has been detected once, the medium supplying apparatus 1 according to this embodiment can resolve the double feed state of the media S from which the double feed is detected again more appropriately than in the case of a conventional technology. The operation of the medium supplying apparatus 1 at the time of restarting the rotation drive of the separator roller driving motor 41*a*, after resolving the double feed state by executing the second control, will be described later in detail with reference to FIG. 10.

Figure 10:
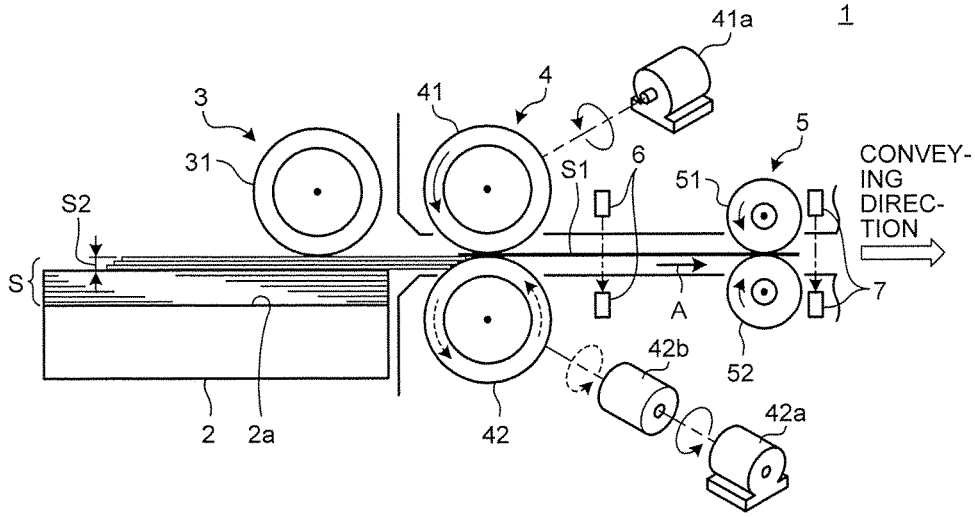
FIG. 10 is a diagram that illustrates an example of the operation of the medium supplying apparatus according to the embodiment.

The medium supplying apparatus 1 illustrated in FIG. 10, after resolving the double feed state by executing the second control described above, cancels the execution of the second control and then, again, restarts the rotation drive of the separator roller 41 by controlling the separator roller driving motor 41*a*. In accordance with the rotation drive of the separator roller 41, the rotation drive of the retard roller 42 is stopped. In the state illustrated in FIG. 10, the medium S1 that is the conveying target is conveyed in a direction (in other words, the conveying direction) denoted by the arrow A, and the front end of the medium S1 disposed on the downstream side passes through the nip part of the conveying unit 5, and the front end of the medium S1 arrives at the position at which the medium detecting sensors 7 are mounted.

In this way, according to the medium supplying apparatus 1 of this embodiment, after two or more sheets are detected once by using the double feed detecting sensor 6, excess sheets are reversely conveyed by the retard roller 42 through the control of stopping the separator roller 41, and one sheet is detected, in a case where two or more sheets are detected again by using the double feed detecting sensor 6 before one sheet, which is the conveying target, is determined to arrive at the next feed roller 51 of the separation unit 4, by setting the load torque applied in the reverse direction of the retard roller 42 to be higher than that at the time of the first double feed detection, re-separation can be reliably performed.

Here, FIG. 11 is a table that illustrates an example of set values of parameters in the medium supplying apparatus 1. In the example illustrated in FIG. 11, the set value of the peripheral speed $V_f$ of the separator roller 41 is 700 mm/s. The set value of the reverse peripheral speed $V_{re}$ of the retard roller 42 is 300 mm/s. The set value of a distance $L_0$ between the nip part of the separation unit 4 and the arrangement position of the double feed detecting sensor 6 is 25 mm. The set value of a distance $L_{s-r}$ between the arrangement position of the double feed detecting sensor 6 and the nip part of the feed roller 51 is 35 mm. The set value of the slow-down distance $L_{td}$ of the separator roller 41 is 10 mm. Such set values are examples, and in this embodiment, the set values of the parameters in the medium supplying apparatus 1 are not limited to the values illustrated in FIG. 11 in a range satisfying a predetermined appropriate condition and the like.

In addition, the medium supplying apparatus 1 according to this embodiment can respond also to a case where the media S are thin sheets. The thin sheets tend to have weak bodies, and a jam (clogging) at the time of conveyance tends to relatively easily occur at the time of separation compared to the case of thick sheets. On the other hand, the thin sheets can be separated also when the reverse-direction load torque of the retard roller 42 is relatively low. In other words, when a double feed is not detected, or when a double feed of the first time is detected, relatively low load torque for which the thin sheets do not cause a damage such as a jam, is set. Accordingly, thin sheets can be re-separated by detecting a double feed once. Subsequently, there is a low possibility that a thin sheet is detected at the second detection of a double feed, and sheets that are difficult to separate can be separated by using high load torque.

FIG. 12 is a table that illustrates an example of a relation between the number of times of detecting a double feed and the torque of the retard roller. More specifically, FIG. 12 illustrates an example of a correspondence table (table) between the number n of times of detecting a double feed during the separation of same sheets and the torque value $T_n$ of the retard roller shaft. In the example illustrated in FIG. 12, the torque value $T_1$ of the retard roller shaft when the number n of detecting a double feed is one, is 50 mN·m. The torque value $T_2$ of the retard roller shaft when the number n of detecting a double feed is two, is 70 mN·m. The torque value $T_3$ of the retard roller shaft when the number n of detecting a double feed is three, is 80 mN·m. Such torque values $T_n$ are examples but are not limited to the values illustrated in FIG. 12. In this embodiment, when the number n of times of detecting a double feed is one, the torque value $T_1$ not causing a jam at the time of conveyance and capable of conveying or separating thin sheets, is set. Since separation of thin sheets are considered to be almost completed when the number n of times of detecting a double feed is one, in a case where a second double feed is detected for the same sheets, the sheets can be regarded as sheets for which it is more difficult for a jam or a damage to occur at the time of conveyance than for thin sheets, and accordingly, a higher torque value $T_2$ for which separation can be stably performed more appropriately can be set. By performing control by storing such a table in the memory 10*b*, a control process in which a low torque value is set when the number of times of detecting a double feed for the same sheets is one, and the torque value is gradually increased as the number of times of detecting a double feed increases, can be performed. In this way, in this embodiment, when the second control described above is executed, the controller 10*a* as the control unit sets the torque value such that the conveying load applied by the torque limiter 42*b* as the torque control mechanism, is increased according to an increase in the number of times of detecting a double feed of media S detected by using the double feed detecting sensor 6. In addition, a system in which reverse-direction load torque of the retard roller 42 is controlled in a stepped manner until a second double feed is detected for the same sheets, may be employed, and a system in which the number of times of detecting a double feed of the same sheets is counted so as to respond to second detection or subsequent detection of a double feed, a table of the double feed detection count number and the reverse-direction load torque of the retard roller 42 is included, and the reverse-direction load torque is controlled in a stepped manner according to the double feed detection count number, may be employed.

In this way, in a case where a double feed is detected for the same sheets, by increasing the load torque in a stepped manner, reliable sheet separation can be performed with the conveyance of thin sheets considered. Naturally, as the double feed detecting sensor 6 is separate away from the feed roller 51, there is an advantage in terms of a re-separable margin.

Figure 13:
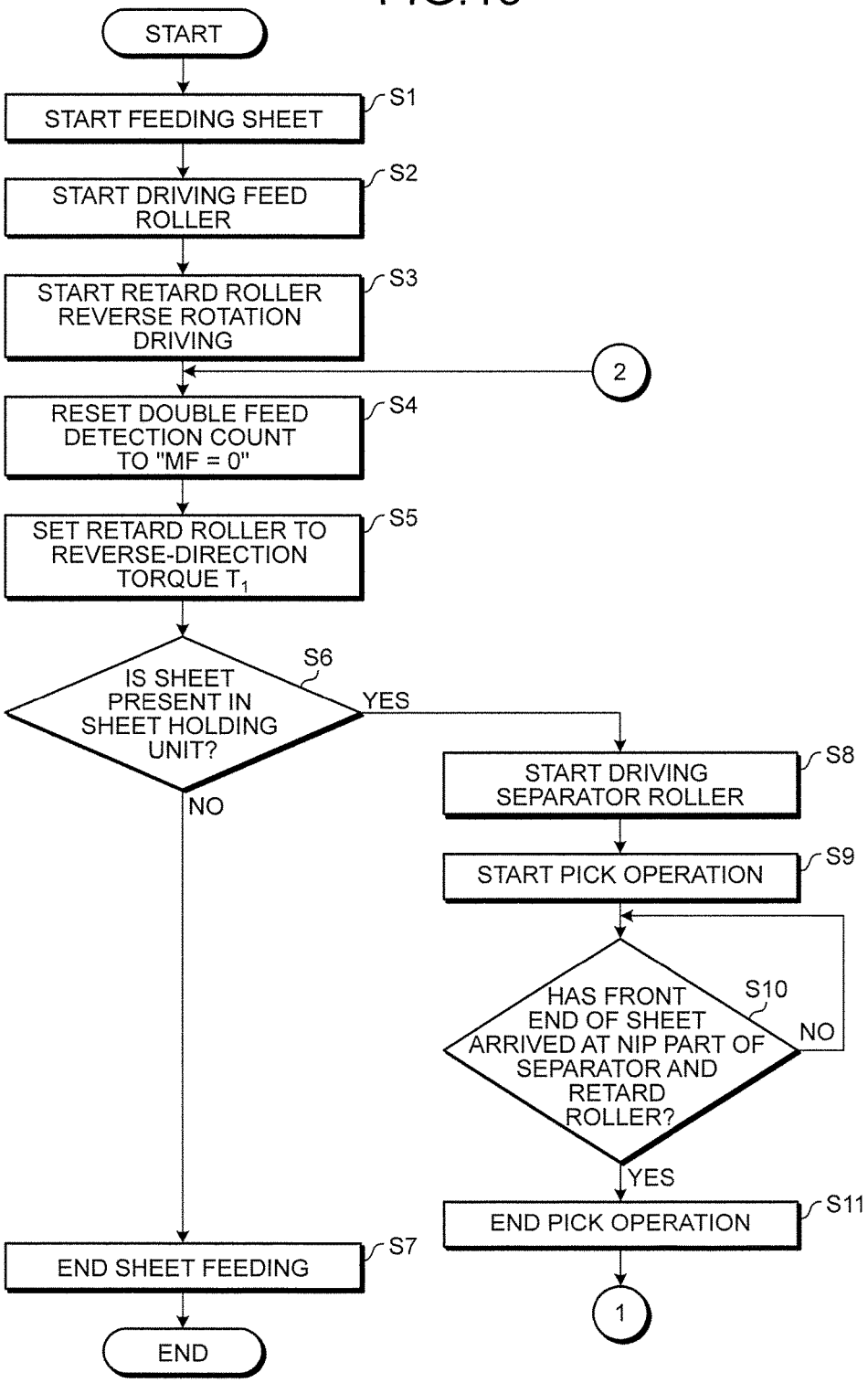
FIG. 13 is a flowchart that illustrates an example of the process of the medium supplying apparatus according to the embodiment.
Figure 14:
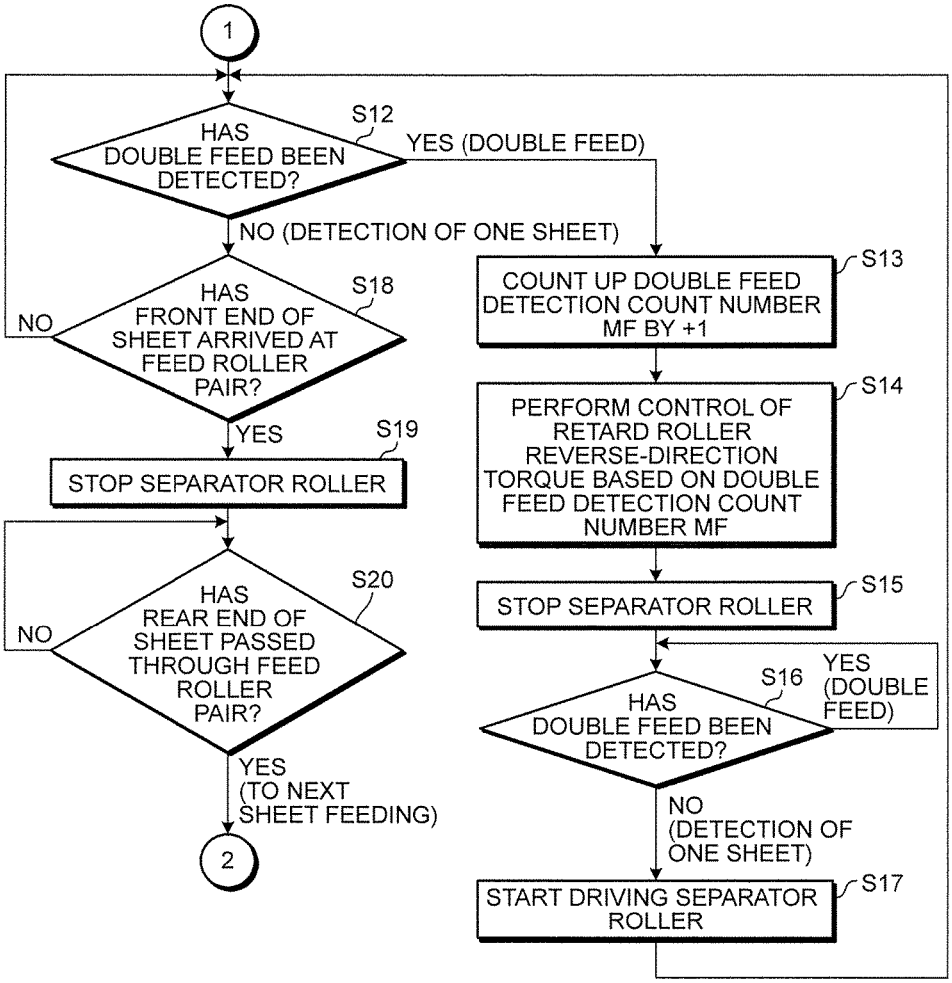
FIG. 14 is a flowchart that illustrates an example of the process of the medium supplying apparatus according to the embodiment.
Figure 15:
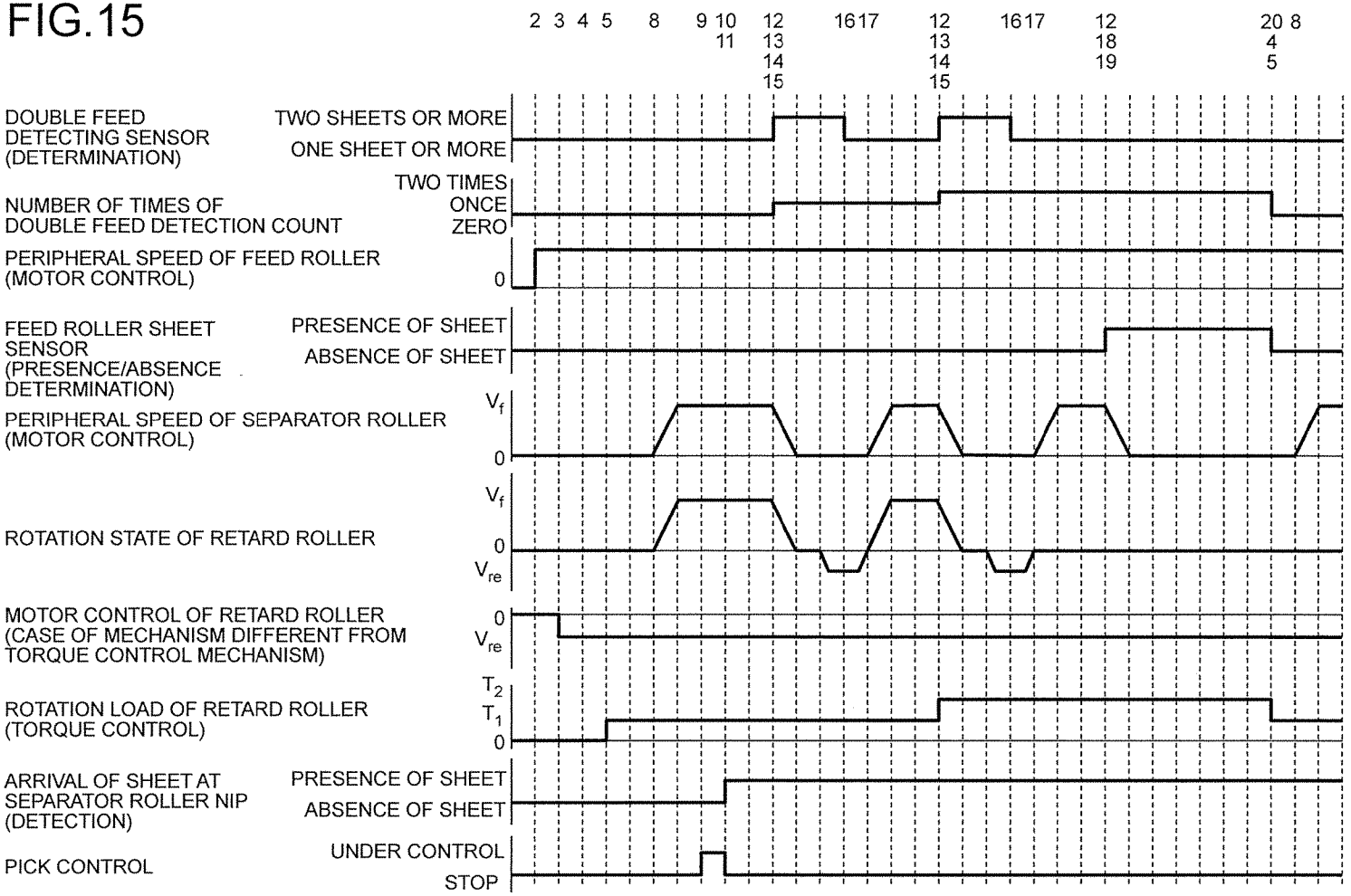
FIG. 15 is a timing diagram that illustrates an example of the states of various mechanisms at the time of performing the process of the medium supplying apparatus illustrated in FIGS. 13 and 14.
Figure 16:
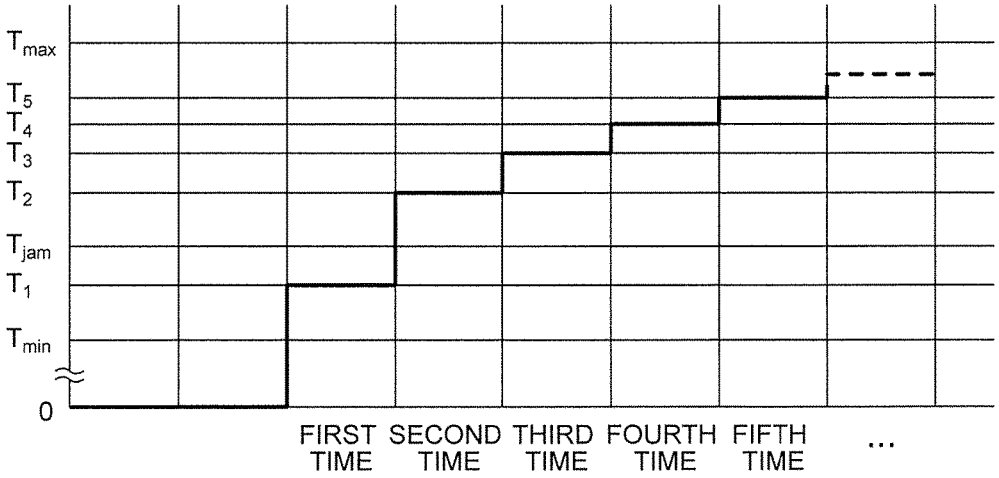
FIG. 16 is a graph that illustrates an example of torque control of a retard roller.

Finally, the process of the medium supplying apparatus 1 according to this embodiment, will be described with reference to FIGS. 13 to 16. FIGS. 13 and 14 represent a flowchart that illustrates an example of the process of the medium supplying apparatus according to the embodiment. FIG. 15 is a timing diagram that illustrates an example of the states of various mechanisms at the time of performing the process of the medium supplying apparatus illustrated in FIGS. 13 and 14. FIG. 16 is a graph that illustrates an example of torque control of the retard roller. Steps S1 to S20 illustrated in FIGS. 13 and 14 correspond to numbers 1 to 20 represented in an upper portion of the timing diagram illustrated in FIG. 15. The timing diagram illustrated in FIG. 15 represents the states of various control mechanisms from the left side to the right side in FIG. 15.

As illustrated in FIG. 13, when a flag representing the start of sheet feeding control for conveying one media S each time from a plurality of stacked sheet-like media S, is set (Step S1), first, the controller 10*a* as the control unit starts driving the feed roller 51 by controlling the feed roller driving motor (Step S2). By referring to FIG. 15, after Step S2, the peripheral speed of the feed roller 51 is a constant speed. Then, the controller 10*a* starts reverse-rotation driving of the retard roller 42 by controlling the retard roller driving motor 42*a* (Step S3). By referring to FIG. 15, in Step S3, the motor control state of the retard roller 42 is changed from "0" to $V_{re}$. Then, the controller 10*a* resets the double feed detection count (the number of times of detecting a double feed) stored in the memory 10*b*, to "MF=0" (Step S4). Then, the controller 10*a* sets the reverse-direction load torque of the retard roller 42 to $T_1$ by controlling the torque limiter 42*b* as the torque control mechanism (Step S5). By referring to FIG. 15, in Step S5, the rotation load state of the retard roller 42, is changed from "0" to $T_1$.

Subsequently, the controller 10*a* determines whether or not a sheet as a medium is present in the hopper 2 as a sheet holding unit (Step S6). In Step S6, for example, the controller 10*a* determines whether or not a sheet (medium) is present in the hopper 2 based on a detection signal which is output from a detecting sensor or the like that can be disposed at an arbitrary position on the loading face 2*a* of the hopper 2. In Step S6, in a case where a sheet is determined not to be present (Step S6: No), the controller 10*a* sets a flag that represents the end of the sheet feeding control described above (Step S7). Thereafter, this process ends.

On the other hand, in Step S6, in a case where a sheet is determined to be present (Step S6: Yes), the controller 10*a* starts driving the separator roller 41 by controlling the separator roller driving motor 41*a* (Step S8). By referring to FIG. 15, in Step S8, the peripheral speed of the separator roller 41 is change from "0" toward $V_f$. In addition, the rotation state of the retard roller 42 is changed from "0" toward $V_f$. Then, the controller 10*a* starts a pick operation by starting driving the pick roller 31 by controlling the pick roller driving motor (Step S9). By referring to FIG. 15, in Step S9, the pick control state is changed from "stop" to "under control".

Subsequently, the controller 10*a* determines whether or not the front end of a sheet as a medium has arrived at the nip part between the separator roller 41 and the retard roller 42 (Step S10). In Step S10, for example, the controller 10*a* determines whether or not the front end of a sheet has arrived at the nip part based on a detection signal which is output by the medium detecting sensor 7 disposed near the nip part of the separation unit 4. In Step S10, in a case where the front end of a sheet is determined to have arrived at the nip part (Step S10: Yes), the controller 10*a* stops the driving of the pick roller 31 by controlling the pick roller driving motor, thereby ending the pick operation (Step S11). By referring to FIG. 15, in Steps S10 and S11, a state representing whether or not a sheet has arrived at the nip part of the separator roller, is changed from absence of a sheet to presence of a sheet, and the pick control state is change from "under control" to "stop". On the other hand, in Step S10, in a case where the front end of a sheet is determined not to have arrived at the nip part (Step S10: No), the controller 10*a* repeats the process of Step S10 until the front end of a sheet is determined to have arrived at the nip part (in other words, Step S10: until Yes determination).

Subsequently, the controller 10*a* determines whether or not a double feed has been detected based on a detection signal which is output from the double feed detecting sensor 6 (Step S12). In Step S12, in a case where a double feed is determined to have been detected (Step S12: Yes), the controller 10*a* counts up "+1" the double feed detection count number MF stored in the memory 10*b* (Step S13). Then, the controller 10*a* controls the reverse-direction torque of the retard roller 42 in accordance with the double feed detection count number MF (in this case, one) stored in the memory 10*b* by controlling the torque limiter 42*b* (Step S14). Then, the controller 10*a* stops the driving of the separator roller 41 by controlling the separator roller driving motor 41*a* (Step S15). Accordingly, in Step S15, the control (the first control described above) for returning a medium that is in the double feed state to be in a direction opposite to the conveying direction is executed by the retard roller 42. By referring to FIG. 15, in Steps S12 to S15, the state of the double feed detecting sensor 6 is changed from "one sheet or less" to "two sheets or more", and the state of the double feed detection count number is changed from "0" to "1". In addition, the peripheral speed of the separator roller 41 is changed from $V_f$ toward "0". In addition, the rotation state of the retard roller 42 is changed from $V_f$ toward "0". In FIG. 15, the rotation state of the retard roller 42 after Step S15 is changed from $V_f$ to "0" and is further changed from "0" to $V_{re}$, and, in the next Step S16, the rotation state of the retard roller 42 becomes a state in which $V_{re}$ is maintained.

Subsequently, the controller 10*a* determines whether or not the double feed state is resolved for the same sheets based on a detection signal which is output from the double feed detecting sensor 6 (Step S16). In Step S16, as a result based on the detection signal which is output from the double feed detecting sensor 6, in a case where it is determined that the sheets in the double feed state are still a plurality of sheets (Step S16: Yes), the double feed state is not resolved, and accordingly, the controller 10*a* repeats the process of Step S16 until the sheets that are in the double feed state in Step S16 become one sheet, and the double feed state is determined to be resolved (in other words, Step S16: until No determination).

On the other hand, in Step S16, as a result based on the detection signal which is output from the double feed detecting sensor 6, in a case where the double feed state is determined to be resolved (Step S16: No), the controller 10*a*, again, starts driving the separator roller 41 by controlling the separator roller driving motor 41*a* (Step S17). By referring to FIG. 15, in Step S16, the state of the double feed detecting sensor 6 is changed from "two sheets or more" to "one sheet or less", and the rotation state of the retard roller 42 is in a state in which $V_{re}$ is maintained. In addition, in Step S17, the peripheral speed of the separator roller 41 is changed from "0" toward $V_f$. In addition, the rotation state of the retard roller 42 passes through "0" from $V_{re}$ and is changed toward $V_f$.

Subsequently, after the process of Step S17, the controller 10*a* determines whether or not a double feed has been detected based on a detection signal which is output from the double feed detecting sensor 6 (Step S12). In Step S12, after the process of Step S17, in a case where a double feed is determined to have been detected (Step S12: Yes), the controller 10*a* further counts up "+1" the double feed detection count number MF stored in the memory 10*b* (Step S13). Then, the controller 10*a* controls the reverse-direction torque of the retard roller 42 in accordance with the double feed detection count number MF (in this case, two) stored in the memory 10*b* by controlling the torque limiter 42*b* (Step S14). Then, the controller 10*a* stops the driving of the separator roller 41 by controlling the separator roller driving motor 41*a* (Step S15). Accordingly, in Step S15, after the media determined to be in the double feed state once are separated, in a case where the media are determined to be in the double feed state again, in a state in which a conveying load larger than that of the first time is applied to the medium for the second time, the control (the second control described above) for returning the media in a direction opposite to the conveying direction, is executed. By referring to FIG. 15, in Steps S12 to S15 after Step S17 described above, the state of the double feed detecting sensor 6 is changed from "one sheet or less" to "two sheets or more", and the state of the double feed detection count is changed from "1" to "2". In addition, the peripheral speed of the separator roller 41 is changed from $V_f$ toward "0". Furthermore, the rotation state of the retard roller 42 is changed from $V_f$ toward "0". In addition, in FIG. 15, the rotation load of the retard roller 42 is changed from $T_1$ to $T_2$. The rotation state of the retard roller 42 after Step S15 is changed from $V_f$ to "0" and is further changed from "0" to $V_{re}$. Then, in the next Step S16, in a state in which the torque value $T_2$ of the retard roller 42 is larger than that of the first time, the rotation state of the retard roller 42 becomes a state in which $V_{re}$ is maintained.

Subsequently, the controller 10*a* determines whether or not the double feed state is resolved for the same sheets based on a detection signal output from the double feed detecting sensor 6 (Step S16). In Step S16, as a result based on the detection signal which is output from the double feed detecting sensor 6, in a case where it is determined that the sheets in the double feed state are still a plurality of sheets (Step S16: Yes), the double feed state is not resolved, and accordingly, the controller 10*a* repeats the process of Step S16 until the sheets that are in the double feed state in Step S16 become one sheet, and the double feed state is determined to be resolved (in other words, Step S16: until No determination).

On the other hand, in Step S16, as a result based on the detection signal which is output from the double feed detecting sensor 6, in a case where the double feed state is determined to be resolved (Step S16: No), the controller 10*a*, again, starts driving the separator roller 41 by controlling the separator roller driving motor 41*a* (Step S17). By referring to FIG. 15, in Step S16 of the second time, the state of the double feed detecting sensor 6 is changed from "two sheets or more" to "one sheet or less", and the rotation state of the retard roller 42 is a state in which $V_{re}$ is maintained. In addition, in Step S16 of the second time, the state of the rotation load of the retard roller 42 is $T_2$ that is larger than $T_1$ at the time of Step S16 of the first time. Furthermore, the peripheral speed of the separator roller 41 is changed from "0" toward $V_f$. In addition, in Step S17 of the second time, the rotation state of the retard roller is changed from $V_{re}$ to "0", and the stopped state is maintained.

Subsequently, the controller 10*a* determines whether or not a double feed has been detected based on a detection signal which is output from the double feed detecting sensor 6 (Step S12). In Step S12, in a case where it is determined that a double feed has not been detected, and the double feed state has been resolved (Step S12: No), the controller 10*a* determines whether or not the front end of a sheet has arrived at the nip part between the feed roller 51 and the driven roller 52 of the conveying unit 5 (Step S18). In Step S18, for example, the controller 10*a* determines whether or not the front end of a sheet has arrived at the nip part of the conveying unit 5 based on a detection signal which is output from a medium detecting sensor or the like that can be disposed at a position located immediately before from the nip part of the conveying unit 5 toward the upstream side. In Step S18, in a case where the controller 10*a* determines that the front end of a sheet has not arrived at the nip part of the conveying unit 5 (Step S18: No), the process is returned to the process of Step S12. On the other hand, in Step S18, in a case where the front end of a sheet is determined to have arrived at the nip part of the conveying unit 5 (Step S18: Yes), the controller 10*a* stops the driving of the separator roller 41 by controlling the separator roller driving motor 41*a* (Step S19). By referring to FIG. 15, in Steps S12, S18, and Step S19, the state of the feed roller sheet sensor is changed from "absence of a sheet" to "presence of a sheet", and the peripheral speed of the separator roller 41 is changed from $V_f$ toward "0".

Subsequently, the controller 10*a* determines whether or not the rear end of the sheet has passed the nip part between the feed roller 51 and the driven roller 52 of the conveying unit 5 (Step S20). In Step S20, for example, the controller 10*a* determines whether or not the rear end of the sheet has passed the nip part of the conveying unit 5 based on detection signals which are output from a medium detecting sensor that can be disposed at a predetermined position on the upstream side of the nip part of the conveying unit 5 and a medium detecting sensor 7 disposed at a predetermined position on the downstream side of the nip part of the conveying unit 5. In Step S20, in a case where the rear end of the sheet is determined not to have passed the nip part of the conveying unit 5 (Step S20: No), the controller 10*a* repeats the process of Step S20 until the rear end of the sheet is determined to have passed the nip part of the conveying unit 5 (in other words, Step S20: until Yes determination). On the other hand, in Step S20, in a case where the rear end of the sheet is determined to have passed the nip part of the conveying unit 5 (Step S20: Yes), the controller 10*a* resets the double feed detection count (the number of times of detecting a double feed) stored in the memory 10*b* to "MF=0" (Step S4). Then, the controller 10*a* sets the reverse-direction torque of the retard roller 42 to $T_1$ by controlling the torque limiter 42*b* as the torque control mechanism (Step S5). By referring to FIG. 15, in Steps S20, S4, and Step S5, the state of the double feed detection number counter is changed from "2" to "0", and the state of the feed roller sheet sensor is changed from "presence of a sheet" to "absence of a sheet". In addition, the state of the motor control of the retard roller 42 is changed from $T_2$ to $T_1$. Thereafter, in order to feed a next sheet, the controller 10*a* proceeds to the process of determining that a sheet is present on the hopper 2 in Step S6 and continues to execute this process until it is determined that a sheet is not present on the hopper 2.

Here, in FIG. 15 described above, as the state of the rotation load of the retard roller 42, the torque values 0 to $T_2$ corresponding to the number of times of detecting a double feed of "0" to "2" have been described as an example but are not limited thereto. The medium supplying apparatus 1 according to this embodiment, as illustrated in FIG. 16, in accordance with an increase in the number of times of detecting a double feed ("1" to "5" in FIG. 16), can perform setting for increasing the torque values ($T_1$ to $T_5$ in FIG. 16) of the retard roller 42. However, the value of the torque value $T_n$ is set to a value not exceeding $T_{max}$ described above.

In this embodiment, while a plurality of sheets are detected by using the double feed detecting sensor 6, and re-separation control is executed, by using the double feed detecting sensor 6, the controller 10*a* determines one medium is in a stage in which an excess sheet starts to be returned, a state in which an excess sheet is returned to the upstream side of the nip part (a contact portion between the separator roller 41 and the retard roller 42 pairs) is a stable state as sheet feeding. For this reason, in a case where the double feed detecting sensor 6 detects "one sheet", instead of immediately driving the separator roller 41 to rotate in the conveying direction, it is preferable to perform delayed control of restarting the rotation drive of the separator roller 41 after waiting for a time corresponding to return of all the excess sheets according to the reverse rotation of the retard roller 42. In other words, when one sheet is detected from a state in which two sheets or more are detected by using the double feed detecting sensor 6 after the detection of the double feed, by providing a delay time until the restart of the rotation of the separator roller 41 and setting the delay time $t_d$ to satisfy a conditional expression of $t_d \geq L_0/V_{re}$ in which the reverse rotation peripheral speed of the retard roller is $V_{re}$, more stable separation control can be executed. Thus, in this embodiment, after the execution of the first control described above, the controller 10*a* as the control unit, after elapse of a predetermined time from when the double feed state of the media S is resolved, and one medium S is determined by using the double feed detecting sensor 6, cancels the first control and restarts the rotation drive of the separator roller 41. For example, in the case of the set values illustrated in FIG. 11 described above, the delay time $t_d$ until the restart of the rotation of the separator roller 41 is $t_d \geq 25/300 \approx 0.083$ [sec], and the separator roller 41 is restarted at least after elapse of 0.083 seconds after "a plurality of sheets" to "one sheet" is determined by using the double feed detecting sensor 6.

In this embodiment, a bundle of sheets from which a double feed is detected are difficult to separate as a tendency, and there is a possibility that a double feed is easily detected therefrom, and accordingly, a low sheet separation speed that is securer, is preferable until the sheets are reliably separated and arrive at the feed roller 51. Thus, the conveying speed of the separator roller 41 is preferably set to be lower than that of normal conveyance, so as to maintain a stable separation state, until a bundle of sheets from which a double feed is detected, are controlled to be re-separated and are respectively detected as one sheet and then, are detected to have arrived at the feed roller 51. Thus, in this embodiment, in a case where the rotation drive of the separator roller 41 is restarted, the controller 10*a* as the control unit conveys the media S to the downstream side in the conveying direction at a conveying speed that is lower than the conveying speed at which the media S are conveyed before the execution of the first control described above. According to the control and the condition described above, more stable re-separation can be performed more appropriately.

In the embodiment described above, as one form for stopping and maintaining the separator roller 41, while a case in which the one-way clutch is provided in a drive transmission system of the separator roller 41, has been described, as another method, it may be configured such that a motor of the drive system of the separator roller 41 is controlled to be stopped and maintained, and the reverse rotation of the separator roller 41 is prevented by using the maintaining torque (in the case of a stepping motor, maximum static torque). In addition, when excess sheets are returned to the hopper 2 through the control according to this embodiment, in order to prevent return of sheets in a bundle on the hopper 2, the pick roller 31 that sequentially feeds sheets from a bundle of sheets stacked on the hopper 2, may be controlled to be separated from the bundle of the sheets when a double feed is detected. Furthermore, for the same reason, when a double feed is detected, the hopper 2 may be controlled to be separated from the pick roller 31.

According to a medium supplying apparatus of the present disclosure, even in a case where, after a double feed state of a medium of which a double feed has been detected once is resolved, a double feed is detected again for the same medium of which the double feed has been detected once, an effect of appropriately resolving the double feed state of the medium of which the double feed is detected again, is acquired.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the present disclosure have been described in detail, it should be understood that the various changes, substitutions, and alterations could be made hereto without departing from the spirit and scope of the disclosure.

What is claimed is:

1. A medium supplying apparatus comprising:

a separator roller configured to convey media to a downstream side in a conveying direction by being driven to rotate in the conveying direction in which the media are conveyed;

a retard roller that is disposed to face the separator roller and is configured to be driven to rotate in a direction opposite to the conveying direction while applying a predetermined conveying load to the media through a torque control mechanism;

a double feed detecting sensor that is disposed on a downstream side of the separator roller and the retard roller in the conveying direction and is configured to detect a double feed of the media; and a control unit configured to convey, by the separator roller, the media to the downstream side in the conveying direction;

detect, by the double feed detecting sensor, a double feed of the media while conveying the media to the downstream side in the conveying direction;

stop, in response to detecting the double feed of the media, rotation drive of the separator roller;

convey, by the retard roller, a part of the media to an upstream side in the conveying direction; and check, by the double feed detecting sensor, for the double feed of the media repeatedly until the media is determined to become one sheet while the rotation drive of the separator roller is being stopped and the part of the media is being conveyed to the upstream side in the conveying direction, wherein when the media is determined to become one sheet, the rotation drive of the separator roller is restarted, wherein the retard roller conveys the part of the media to the upstream side in the conveying direction while awaiting a predetermined time $t_d$ before restarting rotation drive of the separator, and wherein the predetermined time $t_d$ satisfies an expression of $t_d \geq L_0/V_{re}$, wherein $L_0$ represents a distance from where the separator roller and the retard roller come in contact each other to the double feed detecting sensor, and $V_{re}$ represents a reverse peripheral speed of the retard roller when conveying the media in a conveying direction.

2. The medium supplying apparatus according to claim 1, further comprising increasing the conveying load applied by the torque control mechanism, in accordance with an increase in a number of times of detecting the double feed of the media detected by using the double feed detecting sensor.

3. The medium supplying apparatus according to claim 1, wherein, in a case where the rotation drive of the separator roller is restarted, the control unit is configured to convey the media to the downstream side in the conveying direction at a conveying speed lower than a conveying speed at which the media are conveyed before the double feed of the media is detected by the double feed detecting sensor.

4. The medium supplying apparatus according to claim 1, wherein the torque control mechanism is a DC motor or a brushless DC motor.

5. The medium supplying apparatus according to claim 1, wherein the rotation drive of the separator roller is restarted after elapse of a predetermined time from when a double feed state of the media is resolved.

6. The medium supplying apparatus according to claim 2, wherein stopping the rotation drive of the separator roller and conveying the part of the media to the upstream side in the conveying direction according to increasing the conveying load applied by the torque control mechanism.

* * * * *